US008690709B2

(12) United States Patent
Oldknow et al.

(10) Patent No.: US 8,690,709 B2
(45) Date of Patent: Apr. 8, 2014

(54) GOLF CLUB HAVING TWO-PART HEAD

(75) Inventors: Andrew G. V. Oldknow, Portland, OR (US); John T. Stites, Weatherford, TX (US)

(73) Assignee: Nike, Inc., Beaverton, OR (US)

( * ) Notice: Subject to any disclaimer, the term of this patent is extended or adjusted under 35 U.S.C. 154(b) by 346 days.

(21) Appl. No.: 12/564,988

(22) Filed: Sep. 23, 2009

(65) Prior Publication Data

US 2011/0070973 A1 Mar. 24, 2011

(51) Int. Cl.
*A63B 53/04* (2006.01)

(52) U.S. Cl.
USPC ..... 473/349; 473/350

(58) Field of Classification Search
USPC ..... 473/324–350
See application file for complete search history.

(56) References Cited

U.S. PATENT DOCUMENTS

| | | | | | |
|---|---|---|---|---|---|
| 1,968,627 | A | * | 7/1934 | Young | 473/342 |
| 2,332,342 | A | | 10/1943 | Reach | |
| 4,630,827 | A | | 12/1986 | Yoneyama | |
| 4,728,105 | A | | 3/1988 | Kobayashi | |
| 4,775,156 | A | | 10/1988 | Thompson | |
| 4,834,387 | A | | 5/1989 | Waites et al. | |
| 5,009,425 | A | | 4/1991 | Okumoto et al. | |
| 5,486,000 | A | | 1/1996 | Chorne | |
| 5,509,659 | A | | 4/1996 | Igarashi | |
| 6,149,534 | A | * | 11/2000 | Peters et al. | 473/345 |
| 6,506,129 | B2 | | 1/2003 | Chen | |
| 6,814,674 | B2 | | 11/2004 | Clausen et al. | |
| 7,153,219 | B2 | * | 12/2006 | Reed et al. | 473/290 |
| 7,258,628 | B2 | | 8/2007 | Huang et al. | |
| 7,431,665 | B2 | | 10/2008 | Sugimoto | |
| 7,588,503 | B2 | * | 9/2009 | Roach et al. | 473/332 |
| 2003/0176238 | A1 | | 9/2003 | Galloway et al. | |
| 2005/0143189 | A1 | | 6/2005 | Lai et al. | |
| 2006/0052179 | A1 | | 3/2006 | Hou | |
| 2006/0229141 | A1 | | 10/2006 | Galloway | |
| 2007/0099721 | A1 | | 5/2007 | Chen | |
| 2007/0232410 | A1 | | 10/2007 | Chu | |
| 2008/0039231 | A1 | | 2/2008 | Lin et al. | |
| 2008/0076597 | A1 | | 3/2008 | Roach et al. | |

FOREIGN PATENT DOCUMENTS

| | | | | | |
|---|---|---|---|---|---|
| JP | 01017668 | A | * | 1/1989 | A63B 53/04 |
| JP | 02191476 | A | * | 7/1990 | A63B 53/04 |
| JP | 04124243 | A | * | 4/1992 | C22C 27/04 |
| JP | 05277214 | A | * | 10/1993 | A63B 53/04 |
| JP | 06296715 | A | * | 10/1994 | A63B 53/04 |
| JP | 07155410 | A | * | 6/1995 | A63B 53/04 |

(Continued)

OTHER PUBLICATIONS

PCT/US2010/044489, International Search Report and Written Opinion, mailed Dec. 6, 2010.

(Continued)

*Primary Examiner* — Alvin Hunter
(74) *Attorney, Agent, or Firm* — Banner & Witcoff, Ltd.

(57) ABSTRACT

A golf club with a golf club head formed of two distinct parts is presented. The club head includes a lower, ball striking member configured to contact a golf ball. The club head further includes an upper member, connected to the ball striking member at a top surface of the ball striking member. The ball striking member may be formed of a more dense material than the upper portion, thereby lowering the center of gravity of the club to provide improved performance characteristics.

23 Claims, 4 Drawing Sheets

(56) References Cited

FOREIGN PATENT DOCUMENTS

| | | | | | |
|---|---|---|---|---|---|
| JP | 07275412 | A | * | 10/1995 | A63B 53/04 |
| JP | 08057089 | A | * | 3/1996 | A63B 53/04 |
| JP | 09108388 | A | * | 4/1997 | A63B 53/04 |
| JP | 09154986 | A | * | 6/1997 | A63B 53/04 |
| JP | 09271544 | A | * | 10/1997 | A63B 53/04 |
| JP | 10015126 | A | * | 1/1998 | A63B 53/04 |
| JP | 10151231 | A | * | 6/1998 | A63B 53/04 |
| JP | 11057085 | A | * | 3/1999 | A63B 53/04 |
| JP | 11128409 | A | * | 5/1999 | A63B 53/04 |
| JP | 2006-122544 | A | | 5/2006 | |

OTHER PUBLICATIONS

Reason for Rejection dated Aug. 28, 2013, in corresponding Japanese Application No. 2012-530880.

* cited by examiner

GOLF CLUB HAVING TWO-PART HEAD

FIELD OF THE INVENTION

This invention relates generally to golf clubs. In particular, the invention relates to golf clubs having a two-part head with one part formed of a more dense material than the other.

BACKGROUND

The popularity of the game of golf has increased immensely in recent decades. All manner of players are looking for equipment that will improve an individual's performance, thereby making the game more enjoyable. For instance, golf clubs having a low center of gravity often are more forgiving clubs. That is, the golf club may strike a golf ball at a less than optimum location on the club face and the shot may still be relatively accurate. As new materials are used in the manufacture of clubs, lowering the center of gravity is often a priority during golf club design. In addition, players have come to expect a certain profile associated with certain golf clubs. Accordingly, a golf club having a low center of gravity while maintaining a traditional face size and profile would be advantageous to golfers at all levels of play.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

Aspects of this invention relate to golf clubs having a two-part golf club head. In some arrangements, the golf club head may be formed of a lower, ball striking member and an upper member. The upper member may be connected to the ball striking member along a top surface of the ball striking member. In some examples, the ball striking member may be formed of a material denser and/or heavier than the material used to form the upper member. This arrangement aids in lowering the center of gravity of the golf club to improve performance.

BRIEF DESCRIPTION OF THE DRAWINGS

A more complete understanding of the present invention and certain advantages thereof may be acquired by referring to the following detailed description in consideration with the accompanying drawings, in which.

Figure 1:
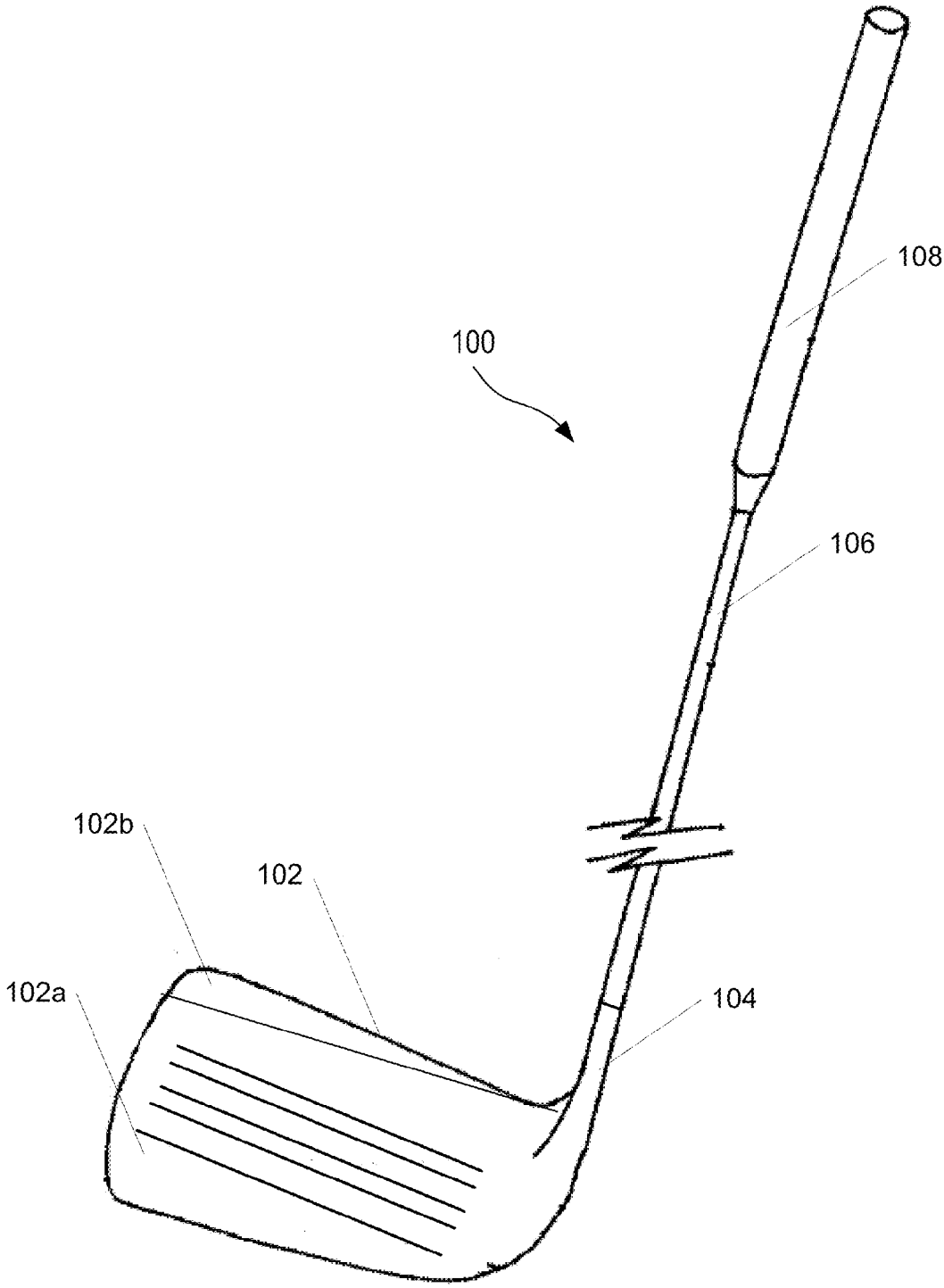
FIG. 1 is an example golf club having a two-part head in accordance with illustrative aspects of the invention.

The reader is advised that the attached drawings are not necessarily drawn to scale.

DETAILED DESCRIPTION

In the following description of various example structures in accordance with the invention, reference is made to the accompanying drawings, which form a part hereof, and in which are shown by way of illustration various example articles, including one or more golf club or golf club head structures. Additionally, it is to be understood that other specific arrangements of parts and structures may be utilized and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention. Further, the invention generally will be described as it relates to iron-type golf clubs. However, aspects of the invention may be used with any of several types of golf clubs, including wood-type golf clubs, hybrid type golf clubs, and the like and nothing in the specification or figures should be construed to limit the invention to use with the iron-type golf clubs described.

A. General Description of an Illustrative Golf Club with Two-Part Golf Club Head In general, as described above, aspects of this invention relate to a golf club or golf club head structure. More detailed descriptions of aspects of this invention follow.

1. Example Golf Clubs Having a Two-Part Head

Aspects of this invention relate to golf club and golf club head structures. In at least some examples, the golf club head is formed of two distinct portions, a first head portion and a second head portion. In some arrangements, the second head portion is arranged vertically above and in contact with the first head portion. For example, the first head portion may be arranged below a horizontal tangent to the notch radius of the club, while the second head portion may be arranged above the horizontal tangent to the notch radius. The first head portion may be formed of a first material and the second head portion may be formed of a second material. In at least some examples, the second material may be less dense than the first material. For instance, in some arrangements, the first material forming the first head portion may be at least one of carbon steel, stainless steel, copper, tungsten, and the like. The second material, forming the second head portion, may be at least one of low density aluminum, titanium, composite materials, ceramic, aluminum alloys, titanium alloys, magnesium alloys, polymers, and the like. In some arrangements, the first material forming the first head portion may be one or more of the above-listed materials with one or more of the second materials embedded within the first material.

In some examples, the first head portion may form a significant portion of the mass of the entire club head. For instance, the first head portion may constitute 45-75% of the overall mass of the club head and, in some arrangements may be 50-60% of the overall mass of the club head. In still other arrangements, the first head portion may be 60-70% of the overall mass of the club or greater than 70% of the overall mass of the club. The second head portion may form a smaller portion of the mass of the club head. For instance, the second head portion may constitute 25-55% of the mass of the club head and, in some arrangements, the second head portion may be 40-50% of the overall mass of the club head. In still other arrangements, the second portion may constitute 30-40% of the overall mass of the club head. Having the increased mass located in the lower region of the club head will aid in lowering the center of gravity of the club.

In some examples, the two-part golf club head may include a ball striking member formed of a first material and an upper body member formed of a second material, the second material being different from the first material. In some arrangements, the second material may be lighter or less dense than the first material. In at least some examples, the ball striking member may form the portion of the club head that is designed or intended to strike a golf ball, while the upper member may not form any portion of the club head that is designed or intended to strike the golf ball.

Additional aspects and specific examples of the articles described above will be described in detail more fully below. The reader should understand that these specific examples are set forth merely to illustrate examples of the invention, and they should not be construed as limiting the invention.

B. Specific Examples of the Invention

Referring to the figures and following discussion, golf clubs and golf club heads in accordance with the present invention are described. As discussed above, the golf club and club head structures described herein may be described in terms of iron-type golf clubs. However, the present invention is not limited to the precise arrangements disclosed herein but applies to golf clubs generally, including wood-type clubs, hybrid clubs, and the like.

Example golf club and golf club head structures in accordance with this invention may constitute iron-type golf clubs. However, aspects of this invention may relate to "wood-type" golf clubs and golf club heads, e.g., clubs and club heads typically used for drivers and fairway woods, as well as for "wood-type" utility or hybrid clubs, or the like. Although these club head structures may have little or no actual "wood" material, they still may be referred to conventionally in the art as "woods" (e.g., "metal woods," "fairway woods," etc.). Although club heads described herein generally include a two-part head, the club heads described herein may also include a multiple piece construction and structure, e.g., including one or more of a sole member, a face member (optionally including a ball striking face integrally formed therein or attached thereto), one or more body members (e.g., material extending around the perimeter and making up the club head body), a crown member, a face plate, a face frame member (to which a ball striking face may be attached), an aft body, etc. Of course, if desired, various portions of the club head structure may be integrally formed with one another, as a unitary, one piece construction, without departing from the invention (e.g., the body member(s) may be integrally formed with the sole and/or crown members, the face member may be integrally formed with the sole, body, and/or crown members, etc.). Optionally, if desired, the various portions of the club head structure (such as the sole member, the crown member, the face member, the body member(s), etc.) individually may be formed from multiple pieces of material without departing from this invention (e.g., a multi-piece crown, a multi-piece sole, etc.). Also, as other alternatives, if desired, each of the two-parts forming the entire club head may each be made as a single, one piece, unitary construction, or a face plate member may be attached to the two-piece club head aft body (optionally, a hollow body, etc.). More specific examples and features of golf club heads and golf club structures according to this invention will be described in detail below in conjunction with the example golf club structures illustrated in FIGS. 1 through 5.

FIG. 1 generally illustrates an example golf club 100 and/or golf club head 102 in accordance with this invention. In addition to the golf club head 102, the overall golf club structure 100 of this example includes a hosel region 104, a shaft member 106 received in and/or inserted into and/or through the hosel region 104, and a grip or handle member 108 attached to the shaft member 106. Optionally, if desired, the external hosel region 104 may be eliminated and the shaft member 106 may be directly inserted into and/or otherwise attached to the head member 102 (e.g., through an opening provided in the top of the club head 102, through an internal hosel member (e.g., provided within an interior chamber defined by the club head 102), etc.).

The shaft member 106 may be received in, engaged with, and/or attached to the club head 102 in any suitable or desired manner, including in conventional manners known and used in the art, without departing from the invention. As more specific examples, the shaft member 106 may be engaged with the club head 102 via a hosel member 104 and/or directly to the club head structure 102, e.g., via adhesives, cements, welding, soldering, mechanical connectors (such as threads, retaining elements, or the like), etc.; through a shaft-receiving sleeve or element extending into the club head body 102; etc. The shaft member 106 also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle member 108 may be attached to, engaged with, and/or extend from the shaft member 106 in any suitable or desired manner, including in conventional manners known and used in the art, e.g., using adhesives or cements; via welding, soldering, adhesives, or the like; via mechanical connectors (such as threads, retaining elements, etc.); etc. As another example, if desired, the grip or handle member 108 may be integrally formed as a unitary, one-piece construction with the shaft member 106. Additionally, any desired grip or handle member materials may be used without departing from this invention, including, for example: rubber materials, leather materials, rubber or other materials including cord or other fabric material embedded therein, polymeric materials, and the like.

The club head 102 itself also may be constructed in any suitable or desired manner and/or from any suitable or desired materials without departing from this invention, including from conventional materials and/or in conventional manners known and used in the art. For example, in the example structure 102 shown in FIG. 1, the club head 102 includes a first member or ball striking member 102*a* (optionally including a ball striking face plate integrally formed with the face member 102*a* or attached to club such that the face plate and a frame member together constitute the overall face member 102*a*). The club head 102 may also include a second member or upper member 102*b* arranged on top of the ball striking member. The upper member 102*b* and ball striking member 102*a* may be formed from known methods of manufacture, such as casting or forging, and the members 202*a*, 202*b* (shown in FIG. 2) may then be joined, as will be discussed more fully below.

A wide variety of overall club head constructions are possible without departing from this invention. For example, if desired, some or all of the various individual parts of the club head 102 described above may be made from multiple pieces that are connected together (e.g., by welding, adhesives, or other fusing techniques; by mechanical connectors; etc.). The various parts (e.g., ball striking member, upper member, etc., may be made from any desired materials and combinations of different materials, including materials that are conventionally known and used in the art, such as metal materials, including lightweight metal materials, and the like. More specific examples of suitable lightweight metal materials include steel, titanium and titanium alloys, aluminum and aluminum alloys, magnesium and magnesium alloys, etc. Additionally or alternatively, the various parts of the club head may be formed of one or more composite materials. Suitable materials for use in each part of the golf club head will be discussed more fully below.

The various individual parts that make up a club head structure 102, if made from multiple pieces, may be engaged with one another and/or held together in any suitable or desired manner, including in conventional manners known and used in the art. For example, the various parts of the club head structure 102, such as the ball striking member 102*a*, the upper member 102*b*, etc., may be joined and/or fixed together (directly or indirectly through intermediate members) by adhesives, cements, welding, soldering, or other bonding or finishing techniques; by mechanical connectors (such as threads, screws, nuts, bolts, or other connectors); and the like. If desired, the mating edges of various parts of the club head structure 102 may include one or more raised ribs, tabs, ledges, or other engagement elements that fit into or onto corresponding grooves, slots, surfaces, ledges, openings, or other structures provided in or on the facing side edge to which it is joined. Cements, adhesives, mechanical connectors, finishing material, or the like may be used in combination with the raised rib/groove/ledge/edge or other connecting structures described above to further help secure the various parts of the club head structure 102 together.

The dimensions and/or other characteristics of a golf club head structure according to examples of this invention may vary significantly without departing from the invention.

Figure 2:
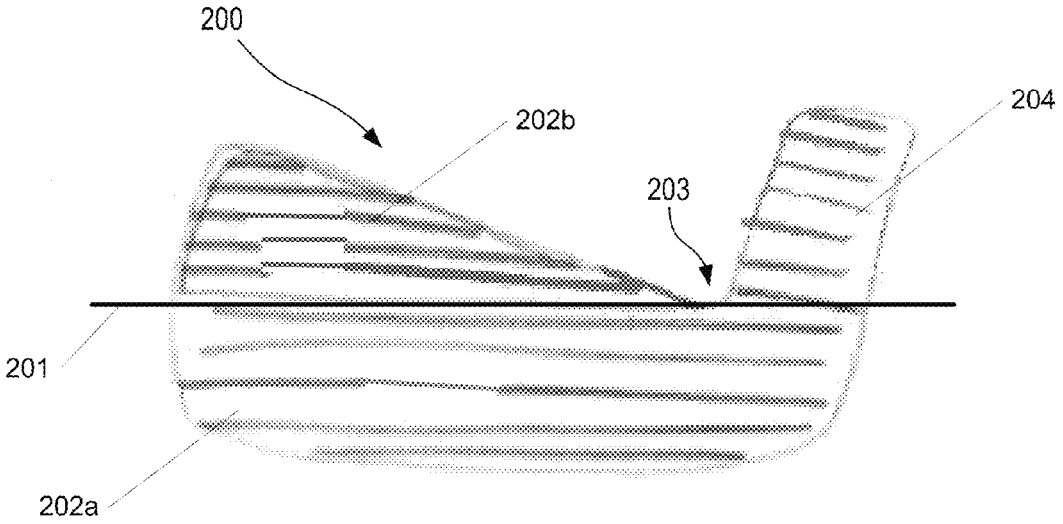
FIG. 2 is an enlarged view of a front side of a two-part golf club head in accordance with illustrative aspects of the invention.

FIG. 2 illustrates a front view of a two-part club head 200 according to aspects described herein. The club head 200 shown in FIG. 2 clearly maintains the appearance of a conventional, single piece club head. That is, the general face size and profile are similar or substantially similar to a conventional club head. However, the club head 200 is formed of two distinct pieces. The club head 200 shown includes a ball striking member 202*a* which is connected to the hosel region 204, which can be connected to a shaft (not shown). The ball striking member 202*a* may be connected to the hosel region 204 via known methods of connection, including adhesives, cements, welding, mechanical fasteners, and the like. In some arrangements, the ball striking member 202*a* may be a portion of the club head positioned below a horizontal tangent to the notch radius 203 of the club, as indicated by line 201, and, in some examples, may be at least 0.84" in height. Stated differently, the center point of the club head may, in some instances be between 0" and 0.84".

In addition, the club head 200 includes an upper member 202*b* that, in some arrangements, may not form a portion of the striking face. That is, the design of the club is such that, as the club head 200 strikes the ball, contact between the club head 200 and the ball may be, and is intended to be, between the ball striking member 202*a* of the club head 200 and the golf ball and not between the upper member 202*b* and the golf ball. In some arrangements, the upper member 202*b* may be positioned above the horizontal tangent 201 to the notch radius 203 of the club. The upper member 202*b* may be arranged on a top surface (such as top surface 212 in FIG. 4) of the ball striking member 202*a* and may be connected or bonded to the ball striking member 202*a* via known methods of attachment such as adhesives, cements, mechanical fasteners, mechanical locks, metal joining processes such as welding, brazing, and the like.

In some examples, the ball striking member 202*a* may be formed of a high or higher density material than the upper member 202*b*. For instance, the ball striking member 202*a* may be formed of various types of metals or composite materials having a relatively high density. In some examples, the ball striking member 202*a* may be formed of carbon steel, stainless steel, copper, tungsten or other materials used in ball striking members. The ball striking member 202*a* may form a majority of the mass and volume of the club head. For instance, greater than 45% of the club head 200 mass and volume may be comprised of the ball striking member 202*a*. In some arrangements, the striking portion may comprise 50-60% of the mass of the club head and 50-60% of the volume of the club head. In one example, the mass of the club head may comprise 60-70% of the mass of the club head and 60-70% of the volume of the club head. In still other arrangements, the ball striking member 202*a* may comprise 67% of the mass and volume of the club head.

The upper member 202*b* may be formed of a material less dense than that of the ball striking member 202*a*. For instance, the upper member 202*b* may be formed of various lightweight metals or composite materials, such as low density aluminum, aluminum alloys, titanium, titanium alloys, ceramic, magnesium alloys, polymers, and the like. In some examples, one or more of the upper member materials may be embedded in the lower member material in forming the lower member. The lighter weight nature of the upper member 202*b* relative to the ball striking member 202*a* may result in the club head 200 having a lower center of gravity, or effective center of gravity, than club heads formed of a single material, because more of the weight of the club head 200 is in the lower portion of the club head. Although the center of gravity may be lower in this two-part club head than a conventional club head, the general face size and profile of the traditional club head that golfers have come to expect is maintained with the two-part arrangement. In some arrangements, the upper member 202*b* may comprise less mass and volume of the total club head mass and volume than the ball striking member 202*a*. For instance, the upper member 202*b* may comprise 50% or less of the mass of the club head 200 and 50% or less of the volume of the club head 200. In some arrangements, the upper member 202*b* may comprise 30-50% of the mass and volume of the club head. In still other arrangements, the upper member 202*b* may comprise 33% of the mass and volume of the club head. The chart below illustrates some example mass and volume arrangements of the upper member 202*b* and the lower member 202*a*. The values below are merely examples and are in no way intended to limit the club head mass and volumes to only those values listed.

| Lower Member Mass (% of total club head mass) | Lower Member Volume (% of total club head volume) | Upper Member Mass (% of total club head mass) | Upper Member Volume (% of total club head volume) |
|---|---|---|---|
| 50 | 50 | 50 | 50 |
| 55 | 55 | 45 | 45 |
| 60 | 60 | 40 | 40 |
| 65 | 65 | 35 | 35 |

-continued

| Lower Member Mass (% of total club head mass) | Lower Member Volume (% of total club head volume) | Upper Member Mass (% of total club head mass) | Upper Member Volume (% of total club head volume) |
|---|---|---|---|
| 67 | 67 | 33 | 33 |
| 70 | 70 | 30 | 30 |

In some arrangements, the ball striking member 202*a* may be approximately at least 0.84" and, in some examples, may be greater than 0.84" in height. The upper member 202*b* may be sized to maintain the conventional shape and size of a golf club head.

In some arrangements, the mass and/or volume associated with the lower member 202*a* may be based on the ability or skill level of a player. For instance, more highly skilled players may desire a club with a slightly higher center of gravity than players of low skill to obtain increased performance from the club. Accordingly, a highly skilled player may have a club head with 50-60% of the total mass of the club head in the lower member 202*a*. Players of limited skill or poor players may select a club head with 70% or greater of the total club head mass in the lower member 202*b*. Players of intermediate skill levels may desire a club head having 60-70% of the total club head mass in the lower member 202*b*.

Figure 3:
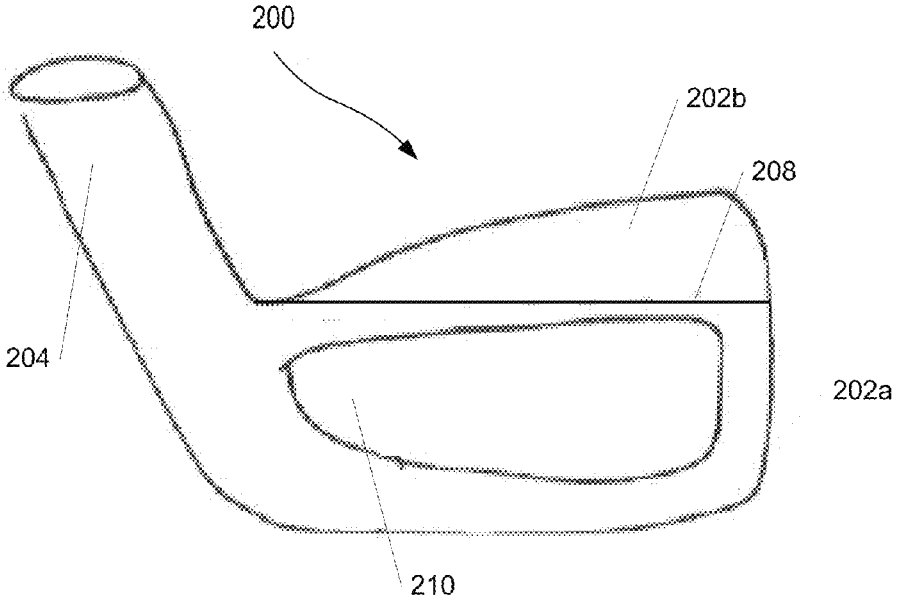
FIG. 3 is an enlarged view of a rear side of a two-part golf club head in accordance with illustrative aspects of the invention.

FIG. 3 is a rear view of the club head 200 of FIG. 2. As shown, the club head 200 has the profile, size and general look of a traditional, one-piece or single material club. However, the club head 200 includes two-pieces 202*a*, 202*b*, as indicated by the separation line 208, and the two pieces are formed of two different materials. The separation line 208 is merely illustrated to indicate one possible location of separation between the ball striking member 202*a* and the upper portion 202*b*. The position of the separation may vary and the separation line 208 between the ball striking member 202*a* and the upper member 202*b* may not be visible when the club is manufactured. However, the separation line 208 is included to indicate a general area of separation between the ball striking member 202*a* and the upper member 202*b*, as shown from a rear view.

The two-part club head arrangement described herein may be used with any type of iron. For instance, the two-part club may be used with blade type irons, cavity-back irons, hybrids, and the like. The golf club head 200 of FIG. 3 illustrates one arrangement having a cavity back. Region 210 indicates an area of the club head 200 that may be generally hollow to reduce weight associated with the club head 200, as well as to further aid in lowering the center of gravity and increase the moment of inertia of the club to provide improved performance. In some arrangements, the upper member 202*b* may also have a hollowed-out region (not shown), which further reduces the weight associated with the upper member 202*b*.

Figure 4:
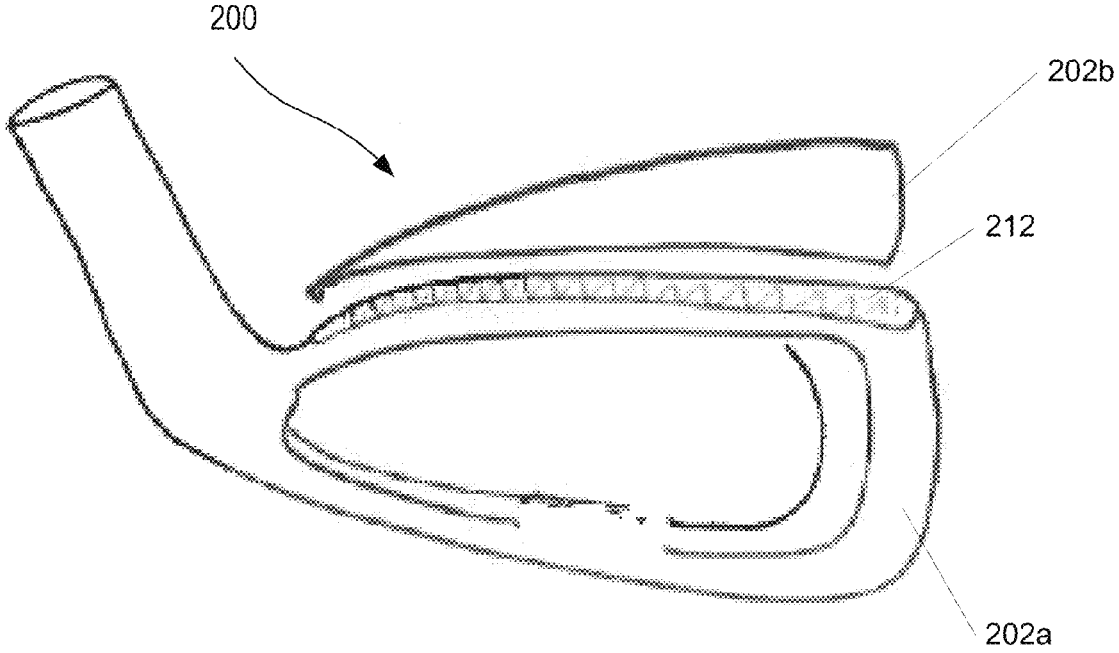
FIG. 4 is an enlarged, exploded view of a rear side of a two-part golf club head in accordance with illustrative aspects of the invention.

FIG. 4 illustrates the club head 200 of FIGS. 2 and 3 in an exploded view. As shown, the upper member 202*b* connects to the ball striking member 202*a* at a top surface 212 of the ball striking member 202*a*. In some arrangements, the top surface 212 may be smooth and flat. In other arrangements, the top surface 212 of the ball striking member 202*a* may have a lip or ridge that corresponds to a lip or ridge in the upper member 202*b* to aid in alignment and connection of the upper member 202*b* to the ball striking member 202*a*. This arrangement will be discussed more fully below. The upper member may be connected to the ball striking member 202*a* via adhesives, cements, welds, mechanical fasteners, mechanical locks, brazing, and the like.

Figure 5:
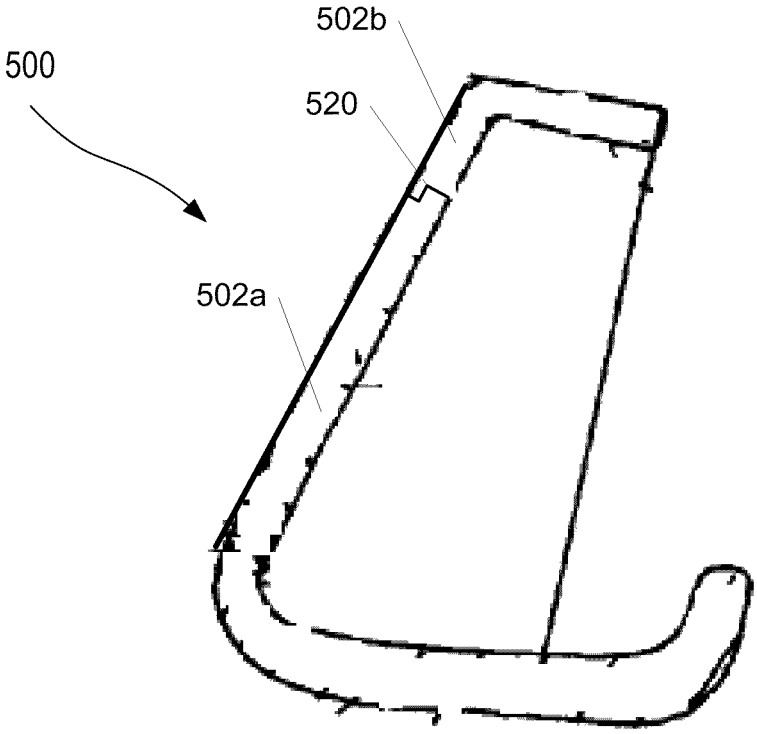
FIG. 5 is a cross-section of a two-part golf club head in accordance with illustrative aspects of the invention.

FIG. 5 is a cross section of a two-part club head 500 as described herein. The cross section illustrates the two-portions 502*a*, 502*b* of the club head 500. Similar to the arrangements discussed above, the upper member 502*b* may be formed of a lighter weight, less dense material than the ball striking member 502*a* in order to provide a club head 500 with a low center of gravity while maintaining the traditional face size and profile of the club.

The cross section further illustrates the mating point 520 of the ball striking member 502*a* and the upper member 502*b*. In the arrangement shown, each of the ball striking member 502*a* and upper member 502*b* include a lip or ridge. The lip or ridge is configured to aid in alignment of the two members 502*a*, 502*b* and connection of the members 502*a*, 502*b*. The ball striking member 502*a* may be joined to the upper member 502*b* via similar methods of joining to those discussed above, such as adhesives, cements, welds, mechanical fasteners, mechanical locks, brazing, and the like. The lip or ridge arrangement shown in FIG. 5 is merely one example arrangement for joining the ball striking member 502*a* and the upper member 502*b*. Various configurations of the lip and ridge, or other arrangements, such as a recessed groove and corresponding rib, may be used to aid in alignment and connection of the members 502*a*, 502*b* without departing from the invention.

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A golf club, comprising:

a club shaft;

a club head configured at one end of the club shaft and having a striking face, the club head including:

a first head portion formed of a first material; and a second head portion, formed separately from the first head portion and stacked vertically on top of the first head portion, wherein the second head portion is connected to the first head portion at a top surface of the first head portion and forms a top portion of the club head, the second head portion is formed of a second material, the second head portion is exposed to a front and a rear of the club head, and the second material is less dense than the first material;

wherein the top surface of the first head portion extends along a horizontal tangent to a notch radius of the club and a lowermost surface of the second head portion extends along the horizontal tangent to the notch radius of the club; and wherein the second head portion is 30-45 percent of the mass of the club head.

2. The golf club of claim 1, wherein the first head portion and the second head portion form two distinct portions of the club head that meet at a connection point.

3. The golf club of claim 2, wherein the connection point includes a ridge formed on the first head portion corresponding to a ridge formed on the second head portion.

4. The golf club of claim 1, wherein the first head portion is connected to the one end of the club shaft.

5. The golf club of claim 1, wherein the second head portion does not form a portion of the striking face intended for contact with a golf ball.

6. The golf club of claim 1, wherein the second head portion is connected to the first head portion using at least one of adhesives, cements, welds, brazing, mechanical locks, and mechanical fasteners.

7. The golf club of claim 1, wherein the first material is at least one of carbon steel, stainless steel, copper and tungsten.

8. The golf club of claim 1, wherein the second material is at least one of aluminum, aluminum alloy, titanium, titanium alloy, magnesium alloy, composite materials, ceramic, and polymers.

9. A golf club, comprising:

a club shaft;

a club head configured at one end of the club shaft and having a striking face, the club head including:

a first head portion formed of a first material; and a second head portion, formed separately from the first head portion and stacked vertically on top of the first head portion, wherein the second head portion is connected to the first head portion at a top surface of the first head portion and forms a top portion of the club head, the second head portion is formed of a second material, the second head portion is exposed to a front and a rear of the club head, and the second material is less dense than the first material;

wherein the second head portion is 30-45 percent of the volume of the club head.

10. A golf club, comprising:

a club shaft;

a club head arranged at one end of the club shaft and having a striking face, the club head including:

a first head portion; and a second head portion, the second head portion constituting 30-45 percent of the mass of the club head, and being exposed to a front and a rear of the club head;

wherein a top surface of the first head portion extends along a horizontal tangent to a notch radius of the club head and a lowermost surface of the second head portion extends along the horizontal tangent to the notch radius of the club and abuts the top surface of the first head portion.

11. The golf club of claim 10, wherein the first head portion is connected to the second head portion via at least one of adhesives, welds, brazing, mechanical locks, and mechanical fasteners.

12. The golf club of claim 10, wherein the first head portion is formed of a first material and the second head portion is formed of a second material, the second material being different from the first material.

13. The golf club of claim 12, wherein the second material is less dense than the first material.

14. The golf club of claim 10, wherein the first head portion includes the striking face intended for contact with a golf ball.

15. The golf club of claim 10, wherein the second head portion forms no part of the striking face intended for contact with a golf ball.

16. A golf club head, comprising:

a ball striking member, the ball striking member being formed of a first material and forming a striking face of the golf club head; and an upper body member, the upper body member being formed of a second material different from the first material, being exposed to a front and a rear of the club head, and being connected to a top surface of the ball striking member;

wherein the top surface of the ball striking member extends along a horizontal tangent to a notch radius of the club head and a lowermost surface of the upper body member extends along the horizontal tangent to the notch radius of the club head; and wherein the second head portion is 30-45 percent of the mass of the club head.

17. The golf club head of claim 16, wherein the ball striking member is connected to the upper body member using at least one of adhesives, welds, brazing, mechanical locks, and mechanical fasteners.

18. The golf club head of claim 16, wherein the first material is more dense than the second material.

19. The golf club head of claim 16, wherein the ball striking member forms a greater percentage of the mass of the golf club head than the upper body member.

20. The golf club head of claim 16, wherein the first material is at least one of carbon steel, stainless steel, copper and tungsten.

21. The golf club head of claim 16, wherein the second material is at least one of aluminum, aluminum alloy, titanium, titanium alloy, magnesium alloy, ceramic, composite and polymer.

22. The golf club head of claim 16, wherein the golf club head is an iron-type golf club head.

23. The golf club head of claim 22, wherein the golf club head is a cavity back golf club head.

* * * * *